US005201878A

United States Patent [19]

Abe et al.

[11] Patent Number: 5,201,878

[45] Date of Patent: Apr. 13, 1993

[54] VANE PUMP WITH PRESSURE CHAMBERS AT THE OUTLET TO REDUCE NOISE

[75] Inventors: Ryutaro Abe, Toyokawa; Yoshiyuki Takeuchi, Gamagori; Michihiro Kitamura, Anjo, all of Japan

[73] Assignee: Toyoda Koki Kabushiki Kaisha, Kariya, Japan

[21] Appl. No.: 772,884

[22] Filed: Oct. 8, 1991

[30] Foreign Application Priority Data

Oct. 11, 1990 [JP] Japan ..... 2-274292

[51] Int. Cl.[5] ..... F04C 2/344; F04C 15/00

[52] U.S. Cl. ..... 418/133; 418/181

[58] Field of Search ..... 418/133, 134, 181

[56] References Cited

U.S. PATENT DOCUMENTS

| | | | |
|---|---|---|---|
| 3,459,275 | 8/1969 | Prillwitz et al. | 418/181 |
| 3,834,846 | 9/1974 | Linder et al. | 418/133 |
| 4,502,854 | 3/1985 | Shibuya et al. | 418/133 |
| 4,747,761 | 5/1988 | Yumiyama et al. | 418/181 |
| 4,752,195 | 6/1988 | Friedrich et al. | 418/133 |
| 4,804,317 | 2/1989 | Smart et al. | 418/133 |
| 4,842,500 | 6/1989 | Fujie et al. | 418/133 |
| 4,978,287 | 12/1990 | Da Costa | 418/181 |
| 4,979,879 | 12/1990 | Da Costa . | |

FOREIGN PATENT DOCUMENTS 0374731 6/1990 European Pat. Off. .

OTHER PUBLICATIONS

Patent Abstracts of Japan, vol. 8, No. 177, (M-317) (1614), Aug. 15, 1984, & JP-A-59-68590, Apr. 18, 1984, M. Sudou, et al., "Muffler of Rotary Compressor".

*Primary Examiner*—Richard A. Bertsch
*Assistant Examiner*—W. J. Wicker
*Attorney, Agent, or Firm*—Oblon, Spivak, McClelland, Maier & Neustadt

[57] ABSTRACT

A vane pump includes a pump housing formed with a cylindrical inner space, intake ports and exhaust ports, a rotating shaft rotatably supported by the pump housing, a rotor received in the cylindrical inner space to be rotated by the rotating shaft, a cam ring disposed in the cylindrical inner space, a plurality of vanes held by the rotor to define plural pump chambers between the rotor and cam ring. Fluid sucked from the intake ports is pressurized and discharged to the exhaust ports. The vane pump is further provided with first and second pressure chambers and a throttle passage connecting the first and second pressure chambers. Pressurized fluid discharged from one of the exhaust ports is led to one of the two pressure chambers and pressurized fluid discharged form the other of the exhaust ports is led to the other of the pressure chambers while pressurized fluid is taken out from the second pressure chamber to be supplied to a fluid device.

2 Claims, 3 Drawing Sheets

VANE PUMP WITH PRESSURE CHAMBERS AT THE OUTLET TO REDUCE NOISE

BACKGROUND OF THE INVENTION

1. Field of the Invention

The present invention relates to a vane pump and more particularly to a vane pump having a pressure chamber for reducing pressure pulsations of pressurized fluid discharged from the pump.

2. Discussion of the Related Art

A conventional vane pump is provided with a pressure chamber formed in a pump housing in order to reduce pressure pulsations of pressurized fluid discharged from the pump. In such a pump, pressurized fluid discharged from exhaust ports is supplied to a fluid device such as a power steering apparatus through the pressure chamber. With this configuration, when pressurized fluid discharged from exhaust ports flows into the pressure chamber, the pressure of the fluid falls due to an increase of the cross section of the fluid passage, whereby the pressure pulsations of the pressurized fluid is decreased.

Thus, in a conventional vane pump having above-mentioned structure, it is necessary to enlarge the volume of the pressure chamber in order to reduce the pressure pulsations efficiently. However, there is a limit to any such increase since the vane pump is desired to be small and light. Furthermore, since a pair of pressurized fluids having the same pressure phase are discharged from a pair of exhaust ports simultaneously, the pressure pulsation of the pressurized fluid is sometimes enhanced in the pressure chamber.

SUMMARY OF THE INVENTION

Accordingly, it is an object of the present invention to provide an improved vane pump which can reduce pressure pulsations of pressurized fluid efficiently.

A vane pump according to the present invention comprises a pump housing formed with a cylindrical inner space, an intake port and an exhaust port, a rotating shaft rotatably supported by the pump housing, a rotor received in the cylindrical space to be rotated by the rotating shaft, a cam ring disposed in the cylindrical inner space, and a plurality of vanes held by the rotor to define plural pump chambers between the rotor and cam ring. Fluid in the intake port is sucked into the pump chambers and pressurized fluid is discharged from the pump chambers to the exhaust port. The vane pump is further provided with at least two pressure chambers and a throttle passage connecting the two pressure chambers. Pressurized fluid discharged from the exhaust port is led to one of the two pressure chambers while pressurized fluid is taken out from the other of the pressure chambers to be supplied to a fluid device.

With this configuration, pressure pulsations included in the pressurized fluid can be reduced effectively. The reduction of the pressure pulsations is carried out when the pressurized fluid flows into the pressure chambers.

In a preferred embodiment, the vane pump is provided with a first exhaust port and second exhaust port, and the first exhaust port is connected with one of the pressure chambers while the second exhaust port is connected with the other of the pressure chambers.

In this case, pressure pulsation is also reduced by pressure interference between first pressurized fluid directly flowing into one of pressure chambers and second pressurized fluid flowing into the one of pressure chambers through the other of pressure chambers and the throttle passage. Therefore, it is possible to effectively reduce pressure pulsations.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
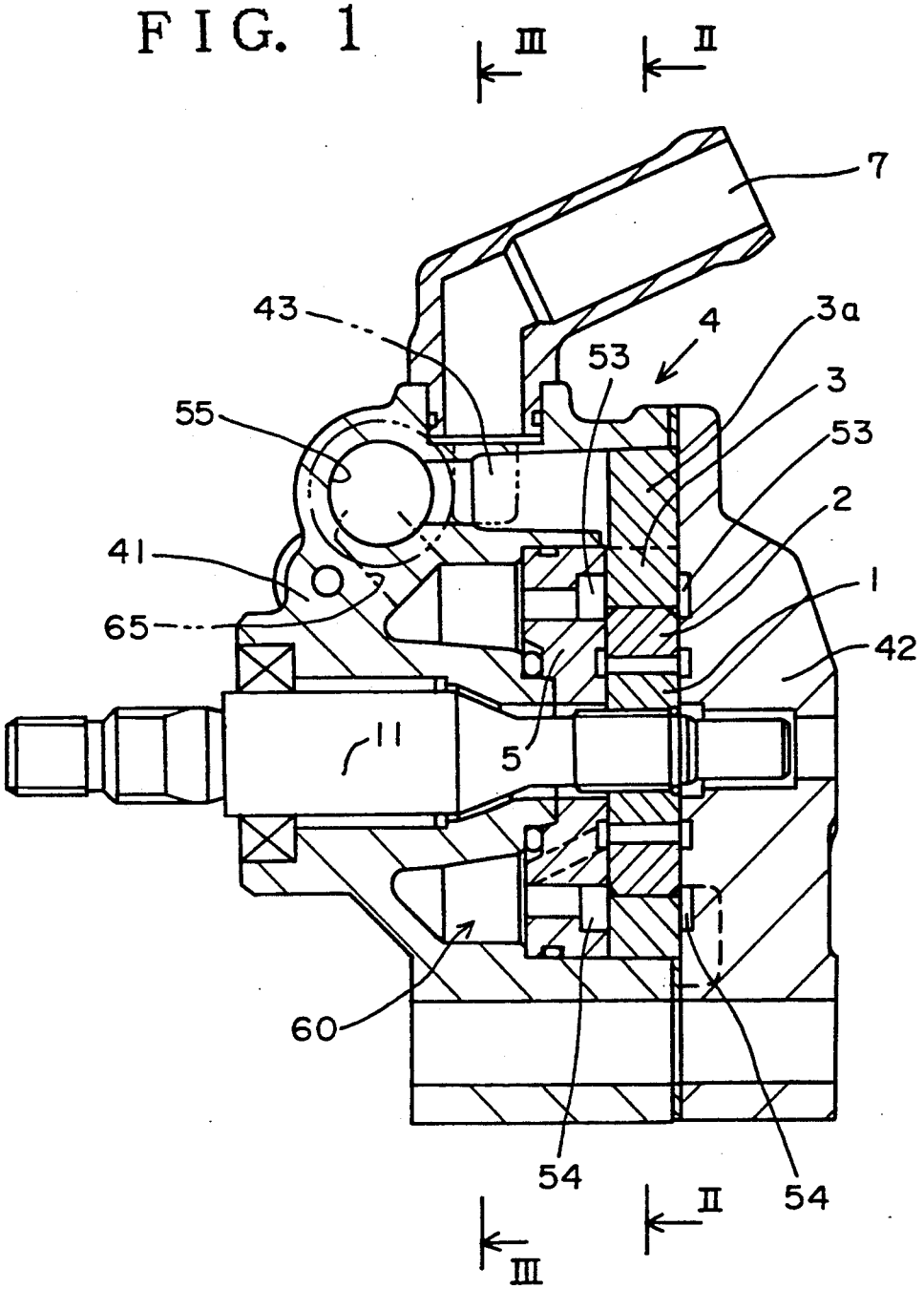
FIG. 1 is a sectional view of a vane pump in accordance with a preferred embodiment of the present invention.
Figure 2:
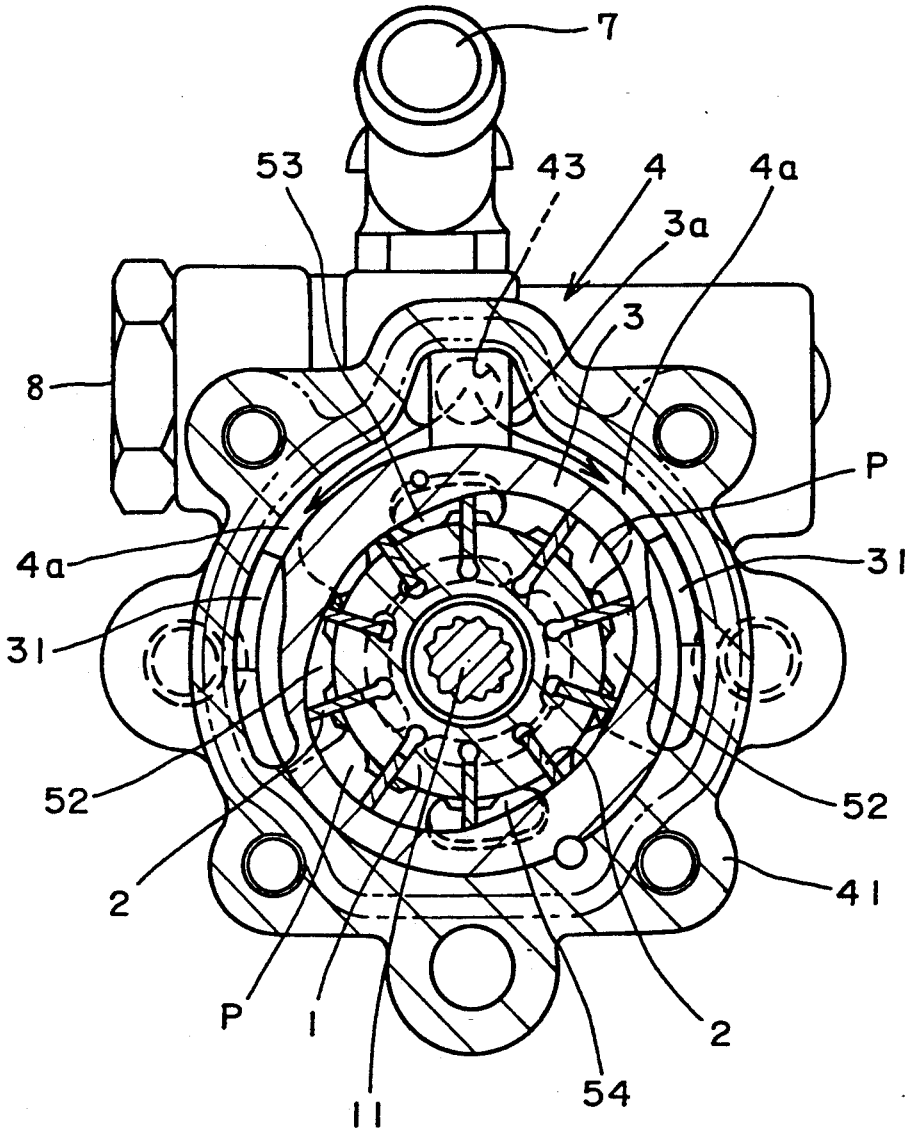
FIG. 2 is a sectional view taken along line II—II in FIG. 1.
Figure 3:
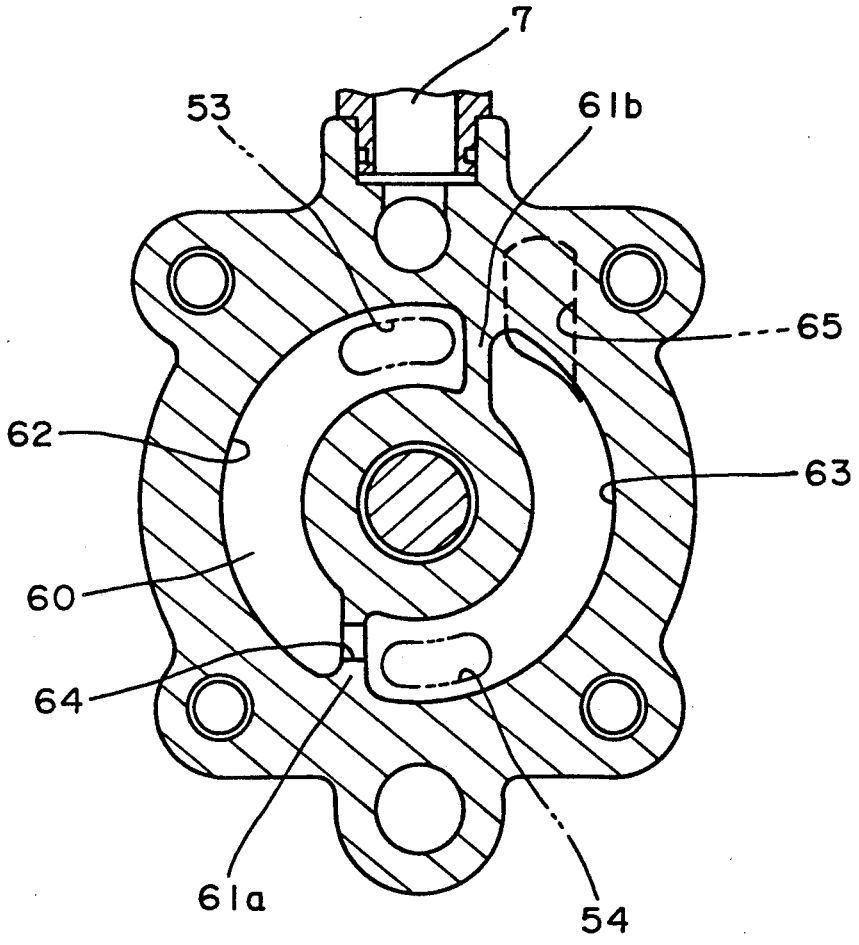
FIG. 3 is a sectional view taken along line III—III in FIG. 1.

A preferred embodiment of the present invention will be described hereinafter with reference to FIGS. 1, 2 and 3. A front housing 41 is combined with a rear housing 42 to form a pump housing 4 which supports a rotating shaft 11 for rotation about its center axis. The front housing 41 is provided with a fluid inlet port 7 and a fluid outlet port 8. A circular rotor 1 is received in a cylindrical inner space of the pump housing 4, and is drivingly connected to the inner end of the rotating shaft 11. A plurality of vanes 2 extending outwardly are held by the rotor 1 for movement in radial direction, and the outer edges of the vanes 2 contact with an internal elliptical cam face of a cam ring 3, which is also received in the cylindrical inner space of the pump housing 4. The rotor 1 and cam ring 3 are contacted at their one sides with the inner end wall of the rear housing 42, and at their other sides with a side plate 5 which is received in the front housing 41. A plurality of pump chambers P are formed between the rotor 1 and cam ring 3, as shown in FIG. 2. Each of the pump chambers P is formed by the rotor 1, cam ring 3, side plate 5, rear housing 42, and two adjacent vanes 2. The volumes of the pump chambers P repeat enlargement and reduction a plural of times in response to each rotation of the rotor 1.

A pair of intake ports 52 and a pair of exhaust ports 53, 54 are formed on each of the inner surface of the side plate 5 and the inner end wall of the rear housing 42 at circumferentially spaced regions of fluid compression. Fluid in the intake ports 52 is sucked into pump chambers P whose volumes increase, while pressurized fluid is discharged from the pump chambers P whose volumes decrease to the exhaust ports 53, 54.

In the pump housing 4, a pair of spaces **4*a* are formed along the peripheral surface of the cam ring 3. Fluid flowing into the pump housing 4 through a fluid inlet port 7 and an inlet passage 43 branches off in right and left directions, as illustrated in arrow of FIG. 2, and flows into the intake ports 52 through the spaces 4*a***.

The exhaust ports 53, 54 formed in the front housing 41 are connected with a pressure chamber 60, and the pressure chamber 60 is connected with a fluid control valve 55. With this configuration, pressurized fluid discharged from the exhaust ports is supplied to a fluid device (not shown) through the pressure chamber 60 and the fluid control valve 55.

The structure of the pressure chamber 60 will now be explained with reference to FIG. 3. The pressure chamber 60 has a circular shape in general, and is divided into a first semicircular pressure chamber 62 and a second semicircular pressure chamber 63 by partition walls 61*a*, 61*b*. The first pressure chamber 62 is connected with the exhaust port 53, and the second pressure chamber 63 is connected with the exhaust port 54. Formed in the partition wall 61*a* is a throttle passage 64 connecting the first and second pressure chambers 62, 63 with each other. Connected to the second pressure chamber 63 is a fluid passage 65 through which pressurized fluid in the second pressure chamber 63 flows toward the fluid control valve 55.

The operation of the vane pump according to the above embodiment will now be explained. When the rotor 1 is rotated, the volumes of plural pump chambers P repeat enlargement and reduction. With this operation, fluid in the intake ports 52 is sucked into pump chambers P whose volumes increase, while pressurized fluid in the pump chambers P whose volumes decrease is discharged to the exhaust ports 53, 54. The pressurized fluid discharged from the exhaust ports 53, 54 inherently includes pressure pulsations therein. The pressure pulsations are reduced when the pressurized fluid flows into the first and second pressure chambers 62, 63. The reduction of pressure pulsations results from enlargement of cross section of the fluid passage at the entrances of the first and second pressure chambers 62, 63. Pressurized fluid in the first pressure chamber 62 flows into the second pressure chamber 63 through the throttle passage 64 formed in the partition wall 61*a*. The phase of pressure pulsation of the pressurized fluid in the first pressure chamber 62 is shifted when the pressurized fluid passes through the throttle passage 64, whereby a phase difference is produced between the first pressurized fluid directly flowing into the second pressure chamber 63 and the second pressurized fluid flowing into the second pressure chamber 63 through the first pressure chamber 62 and the throttle passage 64. This phase difference produces pressure interference between pressure pulsation contained in the first pressurized fluid and pressure pulsation contained in the second pressurized fluid, thereby reducing pressure pulsations of pressurized fluid flowing to the fluid control valve 55 through the fluid passage 65.

As described above, pressure pulsations of pressurized fluid are reduced when the pressurized fluids flow into the first and second pressure chambers 62 and 63, and the pressure pulsations are also reduced by pressure interference between the first pressurized fluid directly flowing into the second pressure chamber 63 and the second pressurized fluid flowing into the second pressure chamber 63 through the first pressure chamber 62 and the throttle passage 64. Therefore, it is possible to effectively reduce the pressure pulsations of the pressurized fluid. The diameter of the throttle passage 64 is adjusted to effectively reduce the pressure pulsations. Further, plural throttle passages may be formed in the partition wall 61*a*.

Although, the pressure chamber 60 is divided into two pressure chambers 62, 63 in the above-mentioned embodiment, the pressure chamber 60 may be divided into four pressure chambers each having an arc shape by four partition walls each of which is formed with a throttle passage.

Obviously, numerous modifications and variations of the present invention are possible in light of the above teachings. It is therefore to be understood that within the scope of the appended claims, the present invention may be practiced otherwise than as specifically described herein.

What is claimed is:

1. A vane pump comprising:

a pump housing having a cylindrical inner space, an inlet port and a fluid outlet port;

a rotating shaft rotatably supported by said pump housing;

a rotor received in the cylindrical space to be rotated by said rotating shaft;

a cam ring disposed in the cylindrical inner space, an inner cam surface of said cam ring facing an outer peripheral surface of said rotor;

a plurality of vanes held by said rotor to define plural pump chambers between said rotor and said cam ring, wherein said cam ring is shaped such that fluid in said pump chambers is compressed at two circumferentially spaced regions of said pump housing, fluid in said inlet port being sucked into said pump chambers and pressurized fluid being discharged from said pump chambers to exhaust ports located at positions circumferentially corresponding to said plural regions first and second pressure chambers, each of said pressure chambers communicating with said pump chambers via said exhaust ports to receive pressurized fluid from said pump chambers, wherein said second pressure chamber is communicated with said fluid outlet port and said first pressure chamber is communicated with said second pressure chamber via a throttle passage such that pressurized fluid from said first pressure chamber is discharged to said second pressure chamber, whereby pressurized fluid pulsations from said first pressure chamber reach said fluid outlet port at a time which is out of phase with pressurized fluid pulsations from said second pressure chamber.

2. A vane pump according to claim 1, wherein each of said pressure chambers has a semicircular shape surrounding said rotating shaft, and said throttle passage is formed in a partition wall between said pressure chambers.

* * * * *